US010191437B2

(12) United States Patent
Furukawa

(10) Patent No.: US 10,191,437 B2
(45) Date of Patent: Jan. 29, 2019

(54) IMAGE FORMING APPARATUS, METHOD OF CONTROLLING IMAGE FORMING APPARATUS, AND NON-TRANSITORY COMPUTER READABLE MEDIUM STORING PROGRAM FOR METHOD OF CONTROLLING IMAGE FORMING APPARATUS

(71) Applicant: Brother Kogyo Kabushiki Kaisha, Nagoya-shi, Aichi-ken (JP)

(72) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/440,874

(22) Filed: Feb. 23, 2017

(65) Prior Publication Data

US 2017/0248893 A1 Aug. 31, 2017

(30) Foreign Application Priority Data

Feb. 26, 2016 (JP) ..... 2016-035476

(51) Int. Cl.
*G03G 15/00* (2006.01)
*G03G 15/01* (2006.01)
(Continued)

(52) U.S. Cl.
CPC ..... *G03G 15/80* (2013.01); *G03G 15/1605* (2013.01); *G03G 15/1615* (2013.01);
(Continued)

(58) Field of Classification Search
CPC ..... G03G 15/0189; G03G 15/1605; G03G 15/1615; G03G 15/1665; G03G 15/167;
(Continued)

(56) References Cited

U.S. PATENT DOCUMENTS

2013/0287417 A1* 10/2013 Saito ..... G03G 15/1675 399/49
2014/0294414 A1 10/2014 Minato
(Continued)

FOREIGN PATENT DOCUMENTS

JP 2013-213993 A 10/2013
JP 2014-202772 A 10/2014

*Primary Examiner* — Joseph S Wong
(74) *Attorney, Agent, or Firm* — Banner & Witcoff, Ltd.

(57) ABSTRACT

There is provided an image forming apparatus including: an intermediate transfer belt; a photosensitive drum; a primary transfer member; a secondary transfer member; a first backup member; a first power supply electrically connected to the primary transfer member and to the secondary transfer member; and a first resistor electrically connected to the first power supply and to the primary transfer member. A first current route, in which the first resistor, the primary transfer member, and the photosensitive drum are connected in series in that order, is connected to the first power supply and to a basis potential. A second current route, in which the secondary transfer member and the first backup member are connected in series, is connected to the first power supply and to the basis potential. The first current route is connected in parallel to the second current route.

22 Claims, 13 Drawing Sheets

(51) Int. Cl.

| | |
|---|---|
| *G03G 21/00* | (2006.01) |
| *G03G 15/16* | (2006.01) |
| *G03G 21/18* | (2006.01) |
| *G03G 21/16* | (2006.01) |

(52) U.S. Cl.
CPC ..... *G03G 15/1675* (2013.01); *G03G 15/0189* (2013.01); *G03G 15/1665* (2013.01); *G03G 15/1685* (2013.01); *G03G 15/5004* (2013.01); *G03G 15/5037* (2013.01); *G03G 15/5054* (2013.01); *G03G 21/0023* (2013.01); *G03G 21/0047* (2013.01); *G03G 21/1652* (2013.01); *G03G 21/1867* (2013.01)

(58) Field of Classification Search
CPC ..... G03G 15/1675; G03G 15/1685; G03G 15/5004; G03G 15/5037; G03G 15/5054; G03G 15/80; G03G 21/0023; G03G 21/0047; G03G 21/1652; G03G 21/1867
See application file for complete search history.

(56) References Cited

U.S. PATENT DOCUMENTS

| | | | | |
|---|---|---|---|---|
| 2015/0003880 | A1* | 1/2015 | Ohno ..... | G03G 15/80 399/302 |
| 2015/0093133 | A1 | 4/2015 | Nakaegawa et al. | |
| 2015/0261142 | A1* | 9/2015 | Makinodan ..... | G03G 15/1615 399/302 |

* cited by examiner

IMAGE FORMING APPARATUS, METHOD OF CONTROLLING IMAGE FORMING APPARATUS, AND NON-TRANSITORY COMPUTER READABLE MEDIUM STORING PROGRAM FOR METHOD OF CONTROLLING IMAGE FORMING APPARATUS

CROSS REFERENCE TO RELATED APPLICATION

The present application claims priority from Japanese Patent Application No. 2016-035476 filed on Feb. 26, 2016, the disclosure of which is incorporated herein by reference in its entirety.

BACKGROUND

Field of the Invention

Technology disclosed in the present specification relates to an image forming apparatus, a method of controlling the image forming apparatus, and a non-transitory computer readable medium storing a program for the method of controlling the image forming apparatus.

Description of the Related Art

There is known an image forming apparatus including: an intermediate transfer belt; a photosensitive drum in contact with an outer circumference surface of the intermediate transfer belt; a primary transfer member sandwiching the intermediate transfer belt between itself and the photosensitive drum; a secondary transfer member in contact with the outer circumference surface of the intermediate transfer belt; and a first backup member sandwiching the intermediate transfer belt between itself and the secondary transfer member. In the image forming apparatus in the intermediate transfer type, a toner image on the photosensitive drum is transferred to the intermediate transfer belt by applying voltage to the primary transfer member, and the toner image on the intermediate transfer belt is transferred to a sheet passing between the secondary transfer member and the intermediate transfer belt by applying voltage to the secondary transfer member.

There is known the following technology for the image forming apparatus in the intermediate transfer type. Namely, each of the photosensitive drum, primary transfer member, first backup member, and secondary transfer member is connected to a power source and to ground potential. The photosensitive drum, primary transfer member, first backup member, and secondary transfer member are connected in series. This configuration allows a common power supply to apply voltage to the primary transfer member and the secondary transfer member.

SUMMARY

According to an aspect of the present teaching, there is provided an image forming apparatus including:

a cylindrical intermediate transfer belt;

a photosensitive drum which is in contact with an outer circumference surface of the intermediate transfer belt;

a primary transfer member sandwiching the intermediate transfer belt between the primary transfer member and the photosensitive drum;

a secondary transfer member which is in contact with the outer circumference surface of the intermediate transfer belt;

a first backup member sandwiching the intermediate transfer belt between the first backup member and the secondary transfer member;

a first power supply electrically connected to the primary transfer member and to the secondary transfer member; and a first resistor electrically connected to the first power supply and to the primary transfer member, wherein a first current route, in which the first resistor, the primary transfer member, and the photosensitive drum are connected in series in that order, is connected to the first power supply and to a basis potential, a second current route, in which the secondary transfer member and the first backup member are connected in series, is connected to the first power supply and to the basis potential, and the first current route is connected in parallel to the second current route.

Technology disclosed in the present specification may be achieved in various embodiments, for example, in embodiments including image forming apparatuses, methods of controlling the image forming apparatuses, computer programs for carrying out functions of the apparatuses and the methods, non-transitory computer readable mediums storing the computer programs, and the like. The computer readable mediums include various recording mediums including, for example, optical discs such as CD-ROM, DVD-ROM, and Blu-ray Disc; magnetic discs such as HDD; and rewritable semiconductor memories. Each of the computer readable mediums may be provided on a server connected to a network. In that case, each of the programs may be downloaded via Internet as needed.

DESCRIPTION OF THE EMBODIMENTS

Figure 1:
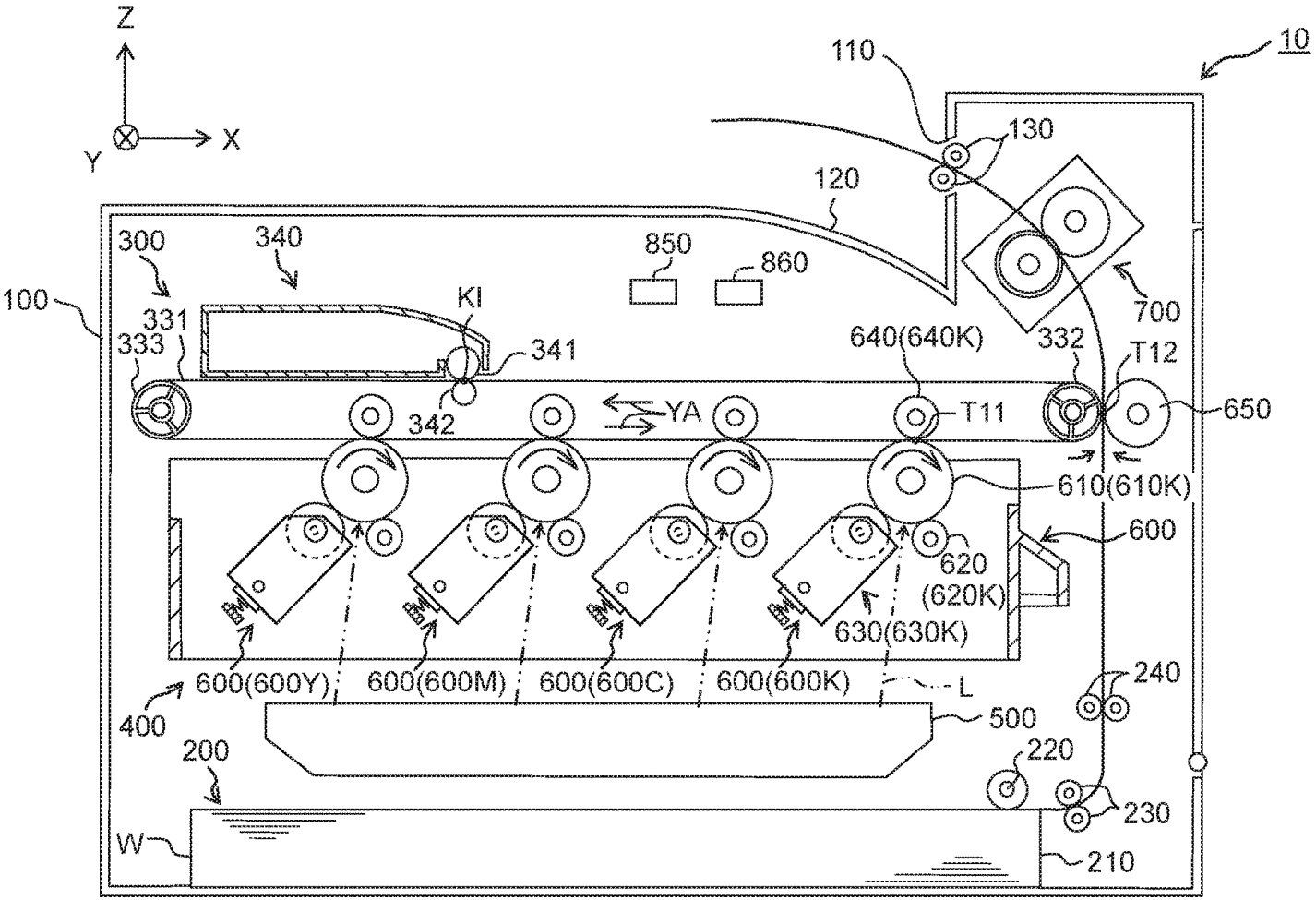
FIG. 1 schematically depicts an overall structure of a printer 10.

A printer 10 according to an embodiment will be described. FIG. 1 schematically depicts an overall structure of the printer 10. FIG. 1 includes XYZ axes orthogonal or perpendicular to each other to specify directions. In the present specification, for the purpose of easy explanation, +Z direction will be referred to as an up direction, −Z direction will be referred to as a down direction, +X direction will be referred to as a front direction, −X direction will be referred to as a rear direction, +Y direction will be referred to as a right direction, and −Y direction will be referred to as a left direction. The same is true on FIG. 5, and the like.

The printer 10 is an electrophotographic printer that forms an image on a sheet W, such as a recording sheet and an OHP sheet, by use of, for example, toners (developers) of four colors including black (K), yellow (Y), magenta (M), and cyan (C). The printer 10 is an exemplary image forming apparatus. In the following, when distinctions between components with similar configurations that are provided corresponding to respective colors of toners, of components configuring the printer 10, are necessary, the components with similar configurations are assigned with alphabetic suffixes of K, Y, M, and C. When such distinctions are not necessary, the alphabetic suffixes will be omitted as appropriate. Further, in the drawings, reference numerals for the components with similar configurations that are provided corresponding to respective colors of toners are written only for a component corresponding to one of the four colors, and reference numerals of components for remaining three colors will be omitted as appropriate.

As depicted in FIG. 1, the printer 10 includes a casing 100, a sheet supply part 200, a belt conveyance unit 300, and an image forming unit 400. The casing 100 accommodates the sheet supply part 200, the belt conveyance unit 300, and the image forming unit 400. A discharge port 110 and discharge tray 120 are formed on an upper surface of the casing 100. A discharge rollers 130 are provided in the vicinity of the discharge port 110 inside the casing 100.

The sheet supply part 200 includes a tray 210, a pick up roller 220, conveyance rollers 230, and registration rollers 240. The tray 210 stores sheets W. The pickup roller 220 takes sheets W stored in the tray 210 one by one. The conveyance rollers 230 convey the sheet W taken out from the tray 210 by use of the pickup roller 220 to the registration rollers 240. The registration rollers 240 correct oblique motion of the sheet W sent from the conveyance rollers 230 and supply the sheet W to the belt conveyance unit 300.

The belt conveyance unit 300 includes a belt 331, a driving roller 332, and a driven roller 333. The driving roller 332 and driven roller 333 are rotatably provided around shafts parallel to each other. The belt 331 is an annular belt, is stretched between the driving roller 332 and the driven roller 333, and rotates following rotation of the driving roller 332. The driving roller 332 is disposed to sandwich the belt 331 between itself and a secondary transfer roller 650 configuring the image forming unit 400. The sheet W conveyed by the registration rollers 240 passes a position TI2 sandwiched between the driving roller 332 and the secondary transfer roller 650 and goes to a fixing unit 700 as described later along with rotation of the belt 331. Primary transfer rollers 640 configuring process units 600 of the image forming unit 400 are provided in the belt conveyance unit 300. The belt 331 is an exemplary intermediate transfer belt, and the driving roller 332 is an exemplary first backup member.

The image forming unit 400 includes an exposure device 500, four process units 600 (600K, 600Y, 600M, and 600C) corresponding to respective colors, the secondary transfer roller 650, and the fixing unit 700. The exposure device 500 irradiates photosensitive drums 610 of the respective processing units 600 with a laser light L (light beam).

The four process units 600 are arranged at a part (lower part), of the outer circumference of the belt 331, moving from the driven roller 333 to the driving roller 332 in a rotation direction YA of the belt 331. In the following, a configuration of the process unit 600K corresponding to black will be described. Configurations of remaining process units 600 corresponding to other colors are same as that of the process unit 600*k*.

The process unit 600K includes a photosensitive drum 610K, a charging roller 620K, a developing unit 630K, and a primary transfer roller 640K. The photosensitive drum 610K, which is a drum-like rotatable member, is disposed in contact with the outer circumference of the belt 331. The charging roller 620K is disposed in contact with a surface of the photosensitive drum 610K to charge the surface of the photosensitive drum 610K uniformly. The developing unit 630K contains a toner and supplies the toner to the surface of the photosensitive drum 610K. The primary transfer roller 640K is disposed on an inner-circumference surface side of the belt 331 to sandwich the belt 331 between itself and the photosensitive drum 610K. The charging roller 620K is an exemplary charger and the primary transfer roller 640K is an exemplary primary transfer member.

The secondary transfer roller 650 is disposed in contact with the outer circumference surface of the belt 331. The secondary transfer roller 650 is an exemplary secondary transfer member.

When the laser light L is emitted from the exposure device 500 to the surface of the photosensitive drum 610K charged by the charting roller 620K, an electrostatic latent image is formed on the surface of the photosensitive drum 610K. When the toner is supplied to the surface of the photosensitive drum 610K by use of the developing unit 630K, the electrostatic latent image formed on the surface of the photosensitive drum 610K is developed to form a toner image. The toner image formed on the surface of the photosensitive drum 610K is transferred on the belt 331 passing a position TI1 sandwiched between the photosensitive drum 610K and the primary transfer roller 640K, by the primary transfer roller 640K to which voltage is being applied. The toner image transferred on the belt 331 is transferred on the sheet W passing the position TI2 sandwiched between the driving roller 332 and the secondary transfer roller 650, by the secondary transfer roller 650 to which voltage is being applied. In the following, the series of operations will be referred to as an image formation operation.

The fixing unit 700 fixes the toner image transferred on the sheet W on the sheet W. The discharge rollers 130 discharge the sheet W passing the fixing unit 700 onto the discharge tray 120 via the discharge port 110.

The printer 10 further includes a belt cleaning unit 340. The belt cleaning unit 340 is disposed in contact with a part (upper part), of the outer circumference surface of the belt 331, moving from the driving roller 332 to the driven roller 333. The belt cleaning unit 340 includes a recovery roller 341 and a backup roller 342. The recovery roller 341 is disposed on an outer-circumference surface side of the belt 331. The recovery roller 341 is disposed downstream of the secondary transfer roller 650 and upstream of the photosensitive drums 610 in the rotation direction YA of the belt 331. The recovery roller 341 is in contact with the outer circumference surface of the belt 331. The backup roller 342 is disposed on the inner-circumference surface side of the belt 331 to sandwich the belt 331 between itself and the recovery roller 341. The belt cleaning unit 340 electrically removes toner adhering to the outer circumference surface of the belt 331, when the belt 331 passes a position KI sandwiched between the recovery roller 341 and the backup roller 342. The recovery roller 341 is an exemplary first contact member and the backup roller 342 is an exemplary second backup member.

The printer 10 further includes a temperature sensor 850 and a humidity sensor 860. The temperature sensor 850 and the humidity sensor 860 are arranged in the casing 100. The temperature sensor 850 outputs a temperature detection signal STA depending on temperature TA in the casing 100. The humidity sensor 860 outputs a humidity detection signal SSA depending on humidity SA in the casing 100.

Figure 2A:
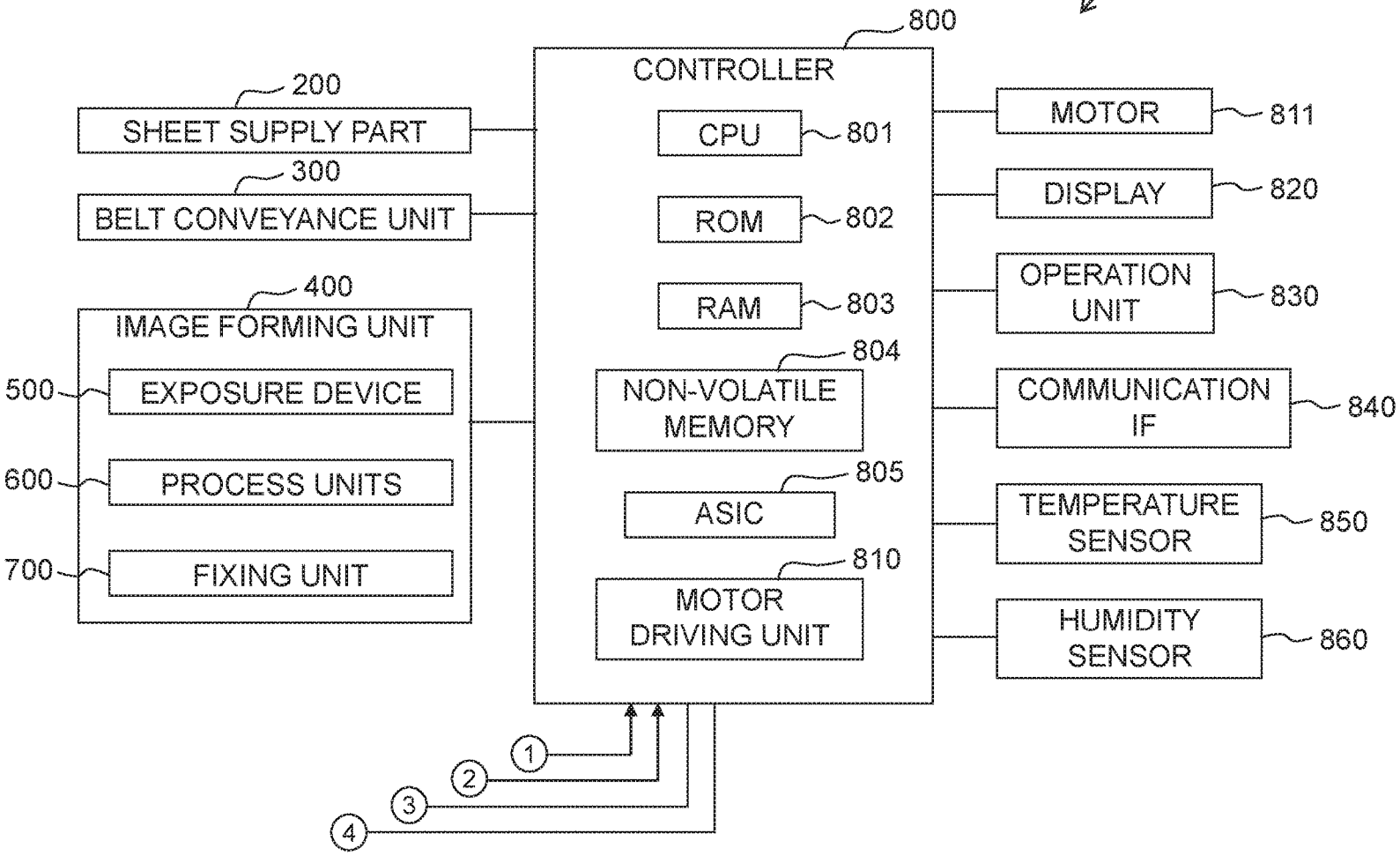
FIGS. 2A and 2B depict a block diagram depicting an electrical configuration of the printer 10 according to an embodiment.
Figure 2B:
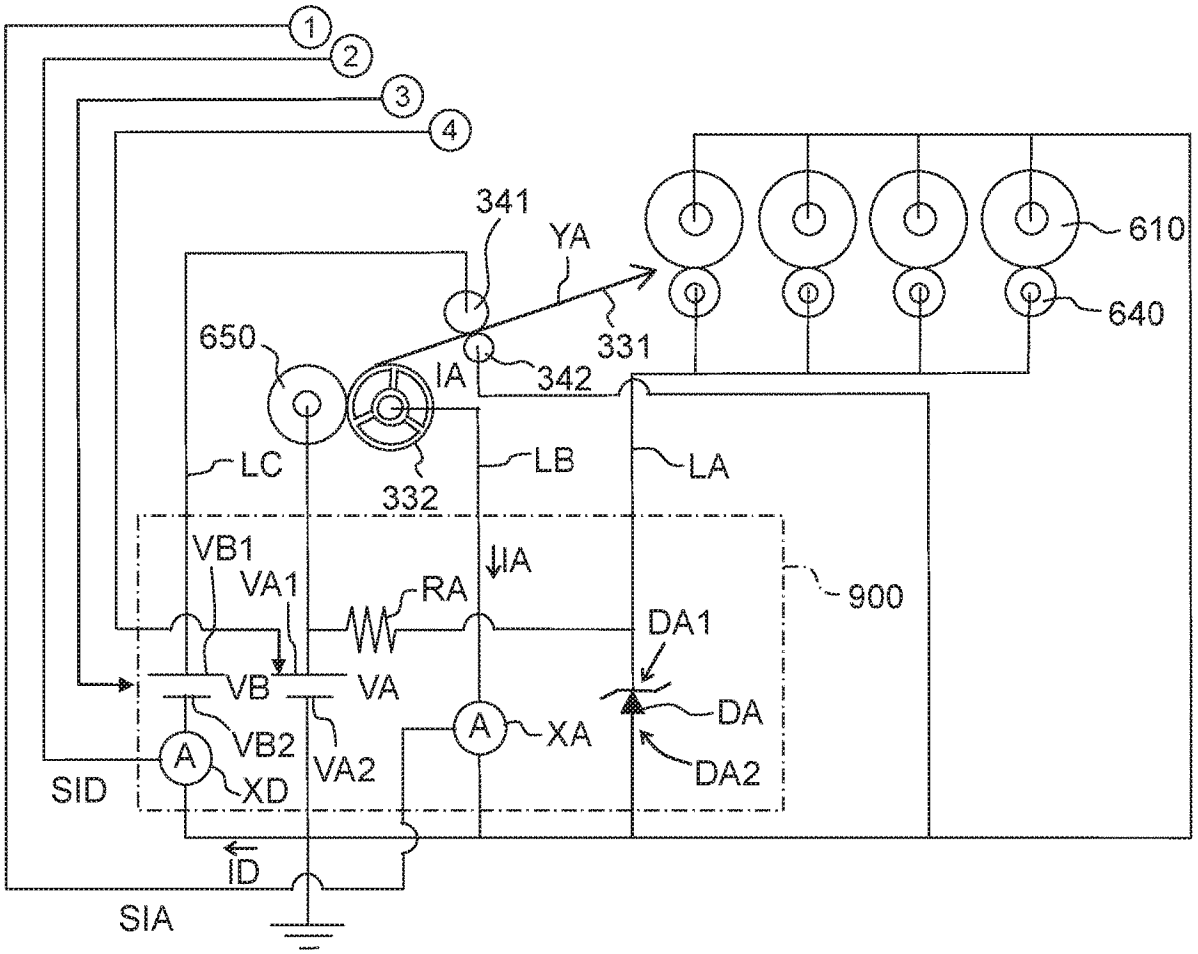

FIG. 2 is a block diagram depicting an electrical configuration of the printer 10. The printer 10 includes, in addition to the sheet supply part 200, the belt conveyance unit 300, the image forming unit 400, and the like, a controller 800, a motor 811, a display unit 820, an operation unit 830, and a communication interface (IF) 340. The controller 800 is an exemplary controller.

The controller 800 includes a CPU 801, a ROM 802, a RAM 803, a non-volatile memory 804, an Application Specific Integrated Circuit (ASIC) 805, and a motor drive unit 810. The ROM 802 stores control programs, a variety of setting information, and the like for controlling the printer 10. The RAM 803 is used as a working area when the CPU 801 executes various programs, or a storage area in which data is stored temporarily. The non-volatile memory 804 is a rewritable memory, such as a NVRAM, flash memory, HDD, or EEPROM. The ASIC 805 is a circuit for image processing, and the like. The CPU 801 controls respective components of the printer 10 depending on control programs read from the ROM 802 and signals sent from various sensors. The motor drive unit 810 drives the motor 811.

The motor 811 rotates and drives the pickup roller 220, the registration rollers 240, the driving roller 332, the photosensitive drums 610, and the like. The display unit 820, which is configured by, for example, a liquid crystal display, displays a variety of information in response to commands from the controller 800. The operation unit 830 includes various buttons and the like through which user's operations may be accepted. The communication interface 840 is hardware enabling communication with an external device. The communication interface 840 is, for example, a network interface, serial communication interface, or parallel communication interface. The communication interface 840 may be hardware enabling radio communication or hardware enabling cable communication.

The printer 10 further includes a power supply substrate 900. The power supply substrate 900 includes a first power supply VA, a resistor RA, a second power supply VB, a first current detection unit XA, a cleaning current detection unit XD, and a constant voltage element DA. A positive-electrode terminal VA1 of the first power supply VA is electrically connected to the primary transfer rollers 640 via the resistor RA. In the following, "being electrically connected" will be referred simply as "being connected". The positive-electrode terminal VA1 of the first power supply VA is connected to the secondary transfer roller 650. Namely, a resistance value between the first power supply VA and each primary transfer roller 640 is greater than a resistance value between the first power surface VA and the secondary transfer roller 650. A negative-electrode terminal VA2 of the first power supply VA is connected to ground potential. In the following, "being connected to the ground potential" will be referred simply as "being connected to the ground". The controller 800 switches the first power supply VA between an on state in which a voltage VP1 is output and an off state in which the voltage VP1 is not output. The controller 800 allows the first power supply VA to change a value of the voltage VP1. The resistor RA is an exemplary first resistor, and the ground potential is an exemplary basis potential.

A positive-electrode terminal VB1 of the second power supply VB is connected to the recovery roller 341. A negative-electrode terminal VB2 of the second power supply VB is connected to the ground. The controller 800 switches the second power supply VB between an on state in which a voltage VP2 is output and an off state in which the voltage VP2 is not output. The controller 800 allows the second power supply VB to change a value of the second power supply VB.

The first current detection unit XA is connected to the driving roller 332 and to the ground potential. The first current detection unit XA detects a current IA flowing across the driving roller 332 and the ground potential and outputs a current detection signal SIA depending on the detected current IA.

The cleaning current detection unit XD is connected to the negative-electrode terminal VB2 of the second power supply VB and to the ground potential. The cleaning current detection unit XD detects a current ID flowing across the negative-electrode terminal VB2 of the second power supply VB and the ground potential and outputs a current detection signal SID depending on the detected current ID.

In the power supply substrate 900 connected as described above, a first current route LA in which the resistor RA, the primary transfer rollers 640, and the photosensitive drums 610 are connected in series in that order is connected to the first power supply VA and to the ground potential, and a second current route LB in which the secondary transfer roller 650, the driving roller 332, and the first current detection unit XA are connected in series in that order is connected to the first power supply VA and to the ground potential. Namely, the first current route LA is connected in parallel to the second current route LB. A third current route LC in which the recovery roller 341 and the backup roller 342 are connected in series in that order is connected to the second power supply VB and to the ground potential.

The constant voltage element DA is, for example, a Zener diode. A high-voltage terminal DA1 as a cathode is connected to the resistor RA and to the primary transfer rollers 640 in the first current route LA. Further, a low-voltage terminal DA2 as an anode is connected to the photosensitive drums 610 and to the ground. The constant voltage element DA is connected in parallel to the primary transfer rollers 640 so that a voltage VT1 (several hundred volts, see FIG. 4) to be applied to the primary transfer rollers 640 may be maintained at a constant voltage. The backup roller 342 is connected to the ground via, for example, a frame sheet metal of the belt conveyance unit 300. The constant voltage element DA is an exemplary second constant voltage element.

Figure 3:
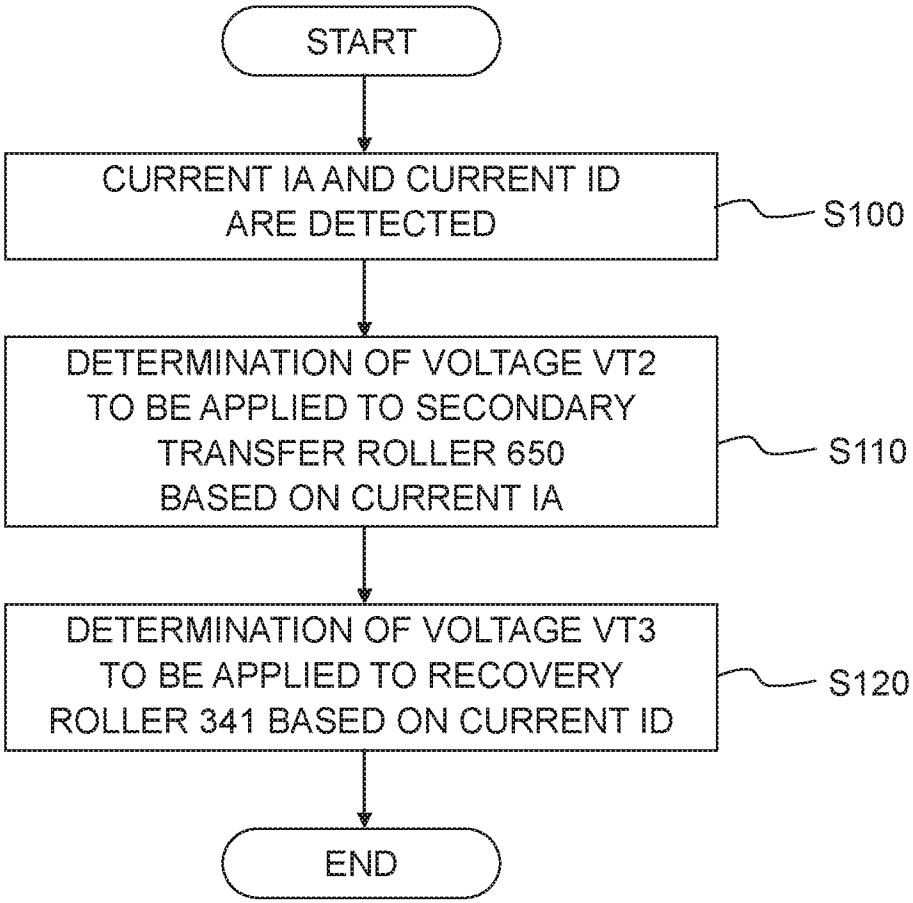
FIG. 3 is a flowchart indicating control processing.

Subsequently, control processing of the controller 800 will be explained. FIG. 3 is a flowchart indicating the control processing. As indicated in FIG. 3, when a user turns on the printer 10 via the operation unit 830, the controller 800 switches the first power supply VA and the second power supply VB into the on state to start the control processing.

When starting the control processing, the controller 800 detects the current IA by using the first current detection unit XA and detects the current ID by using the cleaning current detection unit XD (S100). The controller 800 may detect the current IA from the current detection signal SIA output from the first current detection unit XA and may detect the current ID from the current detection signal SIA output from the cleaning current detection unit XD. The controller 800 determines the voltage VT2 (several kilovolts) to be applied to the secondary transfer roller 650 based on the detected current IA (S110). The controller 800 determines a voltage VT3 to be applied to the recovery roller 341 based on the detected current ID (S120). After determining the voltages VT2 and VT3, the controller 800 switches the first power supply VA and the second power supply VB into the off state and ends the control processing. In the image formation operation, the controller 800 controls the voltage VP1 to be output from the first power supply VA so that the voltage VT2 may be applied to the secondary transfer roller 650, and the controller 800 controls the voltage VP2 to be output from the second power supply VB so that the voltage VT3 may be applied to the recovery roller 341.

In the printer 10 of the present embodiment, each of the first current route LA and the second current route LB is connected to the first power supply VA and to the ground potential, and the first current route LA is connected in parallel to the second current route LB. Thus, the voltage VT1 is applied from the first power supply VA to the primary transfer rollers 640 and the voltage VT2 is applied from the first power supply VA to the secondary transfer roller 650. The power supply substrate 900 may be downsized compared to a case in which voltages are respectively applied to the primary transfer rollers 640 and the secondary transfer roller 650 by separate power supplies. This in turn downsizes the printer 10.

In the printer 10 of the present embodiment, the resistor RA is connected to the first power supply VA and to the primary transfer rollers 640. This makes the voltage VT1 to be applied to the primary transfer rollers 640 different from the voltage VT2 to be applied to the secondary transfer roller 650. In that configuration, a common power supply applies respective voltages to the primary transfer rollers 640 and the secondary transfer roller 650, that is, the common power supply may apply appropriate voltages to the transfer rollers 640 and 650, respectively.

Figure 4:
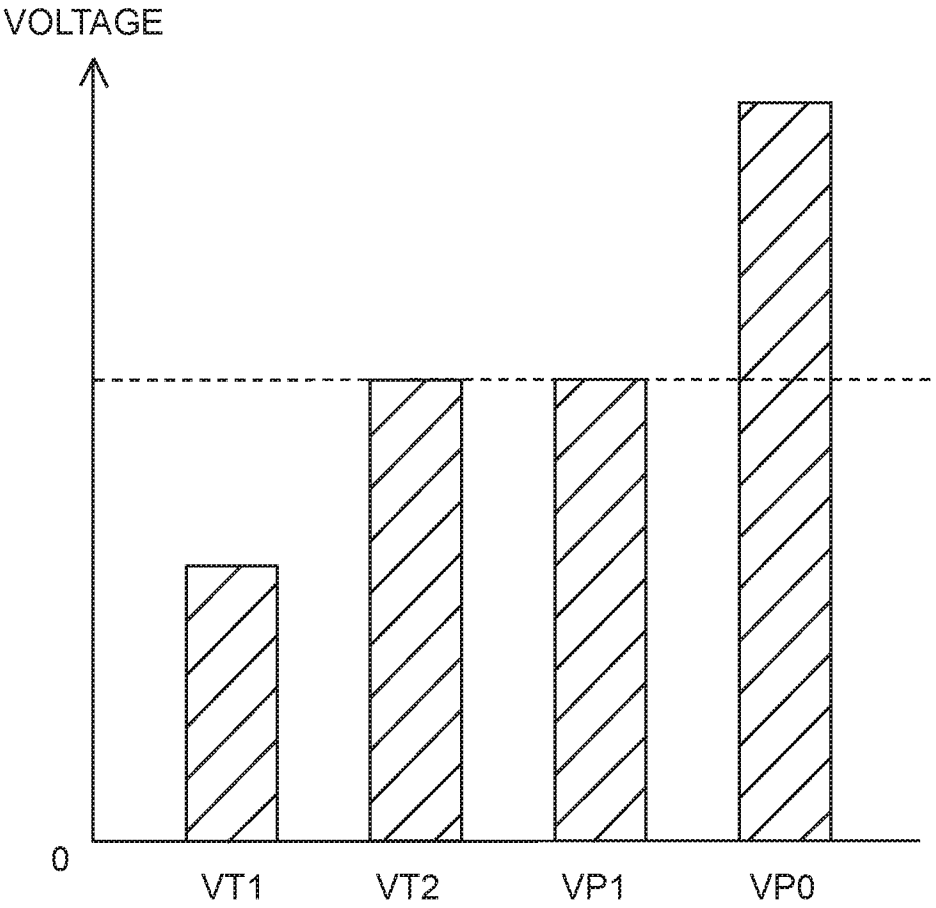
FIG. 4 is a graph indicating relations between a voltage VT1 to be applied to primary transfer rollers 640 and a voltage VT2 to be applied to a secondary transfer roller 650 and a voltage VP1 to be output from a first power supply VA.

FIG. 4 is a graph indicating relations between the voltage VT1 to be applied to the primary transfer rollers 640 and the voltage VT2 to be applied to the secondary transfer roller 650 and the voltage VP1 to be output from the first power supply VA. In the printer 10 of the present embodiment, the voltage VP1 to be output from the first power source VA is substantially equal to the voltage VT2 to be applied to the secondary transfer roller 650. Thus, when a current route, in which the first current route LA is connected in parallel to the second current route LB, is connected to the first power supply VA and to the ground potential, the voltage VP1 to be output from the first power source VA according to the present embodiment may be reduced in contrast to the voltage VP0 to be output from the first power supply VA, according to the related art, where the photosensitive drum, primary transfer member, first backup member and secondary transfer member are connected in series. Namely, it is allowable to reduce a maximum voltage that may be output from the first power supply VA, thus consequently reducing power supply cost.

Figure 5:
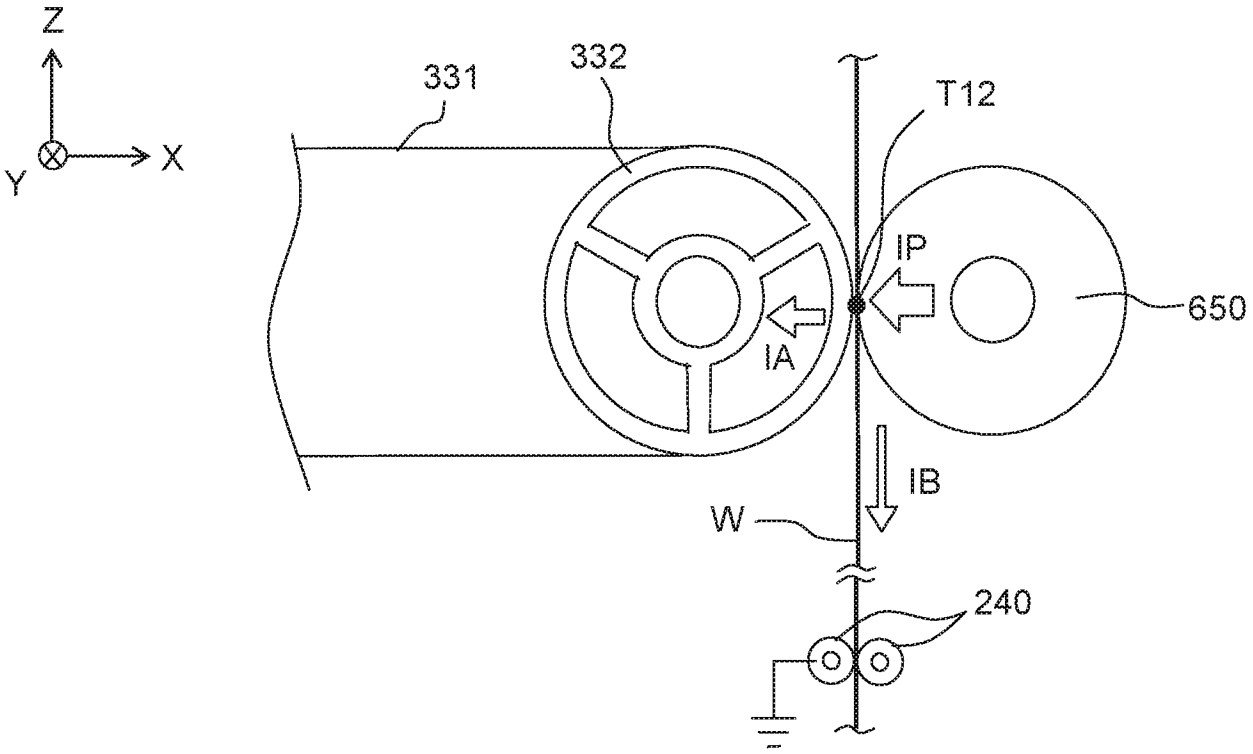
FIG. 5 schematically depicts a relation between a current IP flowing from the first power supply VA to the secondary transfer roller 650 and a current IA flowing from the secondary transfer roller 650 to a driving roller 332.

FIG. 5 schematically depicts a relation between a current IP flowing from the first power supply VA to the secondary transfer roller 650 and the current IA flowing from the secondary transfer roller 650 to the driving roller 332. When no sheet W is present at the position TI2 sandwiched between the secondary transfer roller 650 and the driving roller 332, the current IP flowing from the first power supply VA to the secondary transfer roller 650 is equal to the current IA flowing from the secondary transfer roller 650 to the driving roller 332.

Meanwhile, as depicted in FIG. 5, when the sheet W is present at the position TI2 sandwiched between the secondary transfer roller 650 and the driving roller 332, in particular, when the sheet W present at the position TI2 is moisture-absorbing paper for a resistance value, a part of the current IP (hereinafter referred to as a "leakage current") flowing from the first power supply VA to the secondary transfer roller 650 flows on the sheet W and reaches the registration rollers 240 connected to the ground. Thus, if the first current detection unit XA is connected to the first power supply VA and to the secondary transfer roller 650 to detect the current IP flowing from the first power supply VA to the secondary transfer roller 650, the first current detection unit XA may not accurately detect the current IA flowing from the secondary transfer roller 650 to the driving roller 332.

In the printer 10 of the present embodiment, on the other hand, the first current detection unit XA is connected to the secondary transfer roller 650 and to the ground potential. Thus, as compared to the case in which the first current detection unit XA is connected to the first power supply VA and to the secondary transfer roller 650, the first current detection unit XA of the present embodiment may accurately detect the current IA flowing from the secondary transfer roller 650 to the driving roller 332 regardless of the presence of the sheet W at the position TI2. Further, the first current detection unit XA of the present embodiment may accurately determine the voltage VT2 to be applied to the secondary transfer roller 650 based on the detected current IA. In the printer 10 of the present embodiment, the voltage VP1 to be output from the first power supply VA is made to be small, thus reducing the amount of a leakage current IB.

In the printer 10 of the present embodiment, the driving roller 332 is connected to the ground via the first current detection unit XA. Thus, as compared to a case in which the driving roller 332 is not connected to the ground, it is possible to reduce radiation noise from the driving roller 332.

In the following, constitutive parts or components of a printer 10A according to a first modified embodiment, which are the same as or equivalent to those of the printer 10 of the above embodiment, are designated by the same reference numerals, and any explanation therefor will be omitted as appropriate.

Figure 6A:
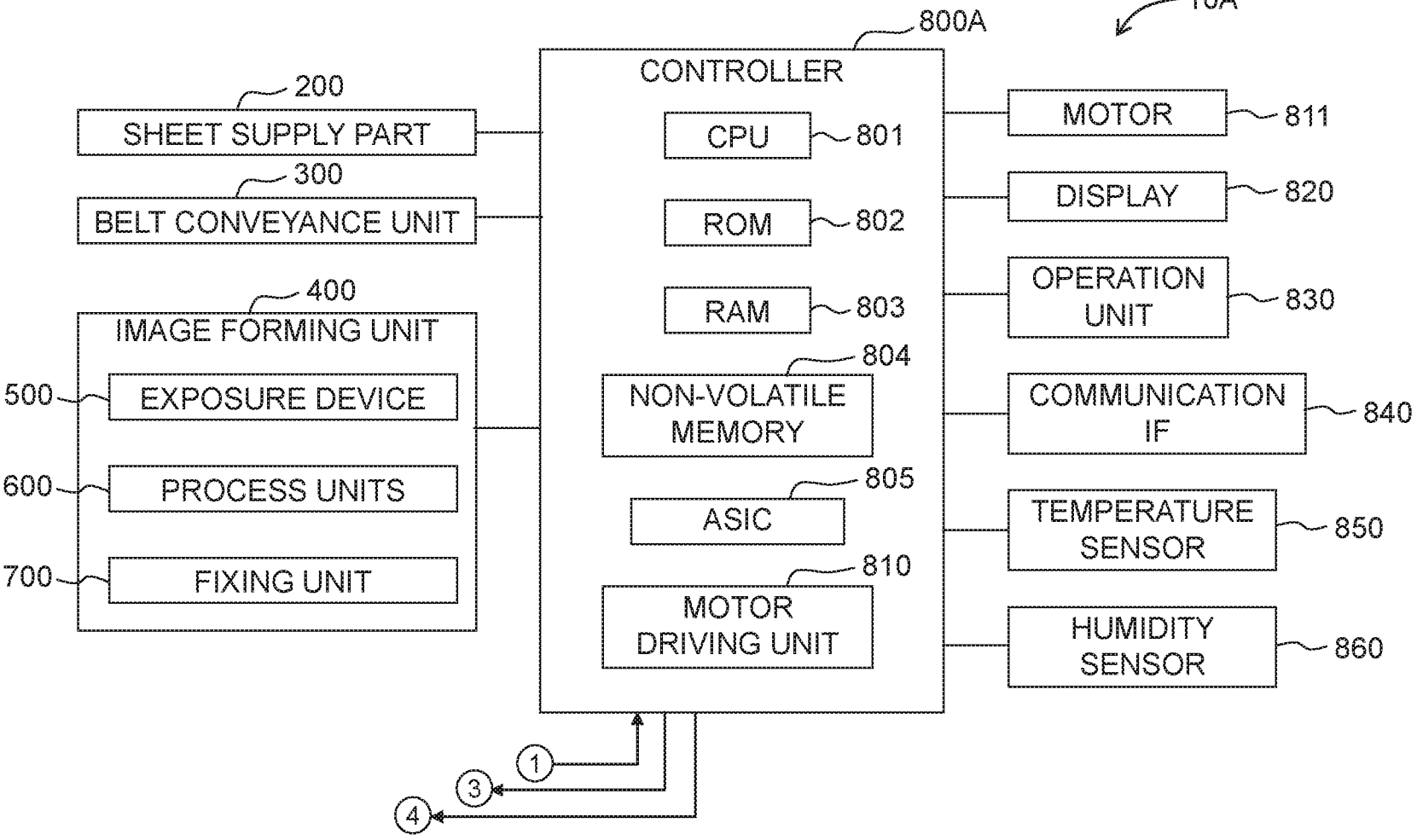
FIGS. 6A and 6B schematically depict an electrical configuration of a printer 10A according to a first modified embodiment.
Figure 6B:
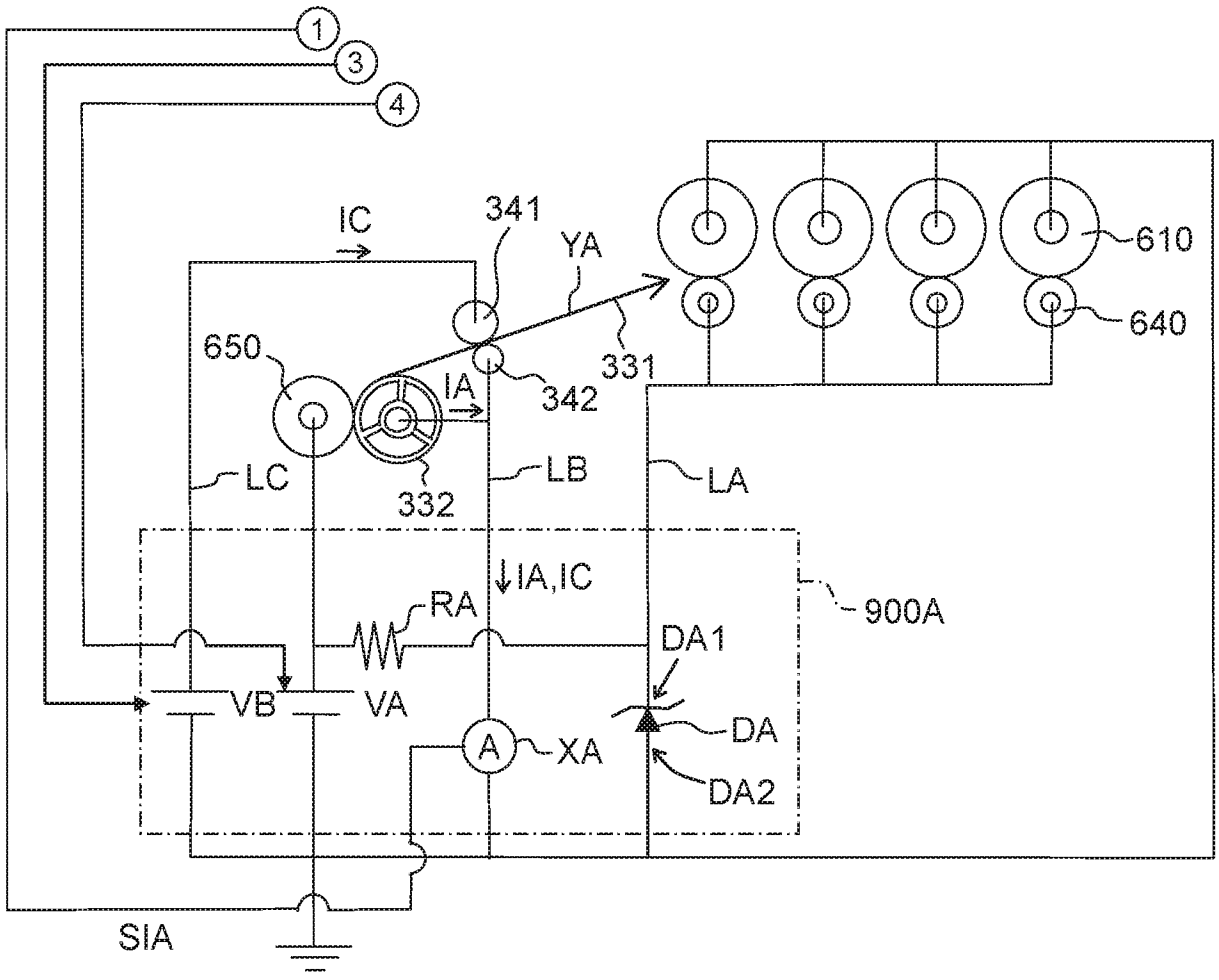

As depicted in FIG. 6, in the printer 10A of the first modified embodiment, the driving roller 332 is connected to the backup roller 342. A power supply substrate 900A includes no cleaning current detection unit XD.

In the printer 10A of the first modified embodiment, the driving roller 332 is connected to the backup roller 342. This allows the current IA flowing through the second current route LB and a current IC flowing through the third current route LC to flow through the first current detection unit XA. A controller 800A switches the first power supply VA into the on state and switches the second power source VB into the off state, when detecting the current IA flowing through the second current route LB by use of the first current detection unit XA. The controller 800A detects the current that is detected by the first current detection unit XA at the time of switching of the first power supply VA and second power supply VB, as the current IA flowing through the second current route LB. The controller 800A switches the first power supply VA into the off state and switches the second power source VB into the on state, when detecting the current IC flowing through the third current route LC by use of the first current detection unit XA. The controller 800A detects the current that is detected by the first current detection unit XA at the time of switching of the first power supply VA and second power supply VB, as the current IC flowing through the third current route LC.

The controller 800A determines the voltage VT2 to be applied to the secondary transfer roller 650 based on the detected current IA, and executes constant voltage control for applying the voltage VT2 to the secondary transfer roller 650 in the image formation operation. The controller 800A determines the voltage VT3 to be applied to the recovery roller 341 based on the detected current IC, and executes constant voltage control for applying the voltage VT3 to the recovery roller 341 in the image formation operation. The voltage VT3 to be applied to the recovery roller 341 by the second power supply VB has the same polarity as the voltage VT2 to be applied to the secondary transfer roller 650 by the first power supply VA. The voltage VT2 is an exemplary first applied voltage, and the voltage VT3 is an exemplary second applied voltage.

In the printer 10A of the first modified embodiment, the driving roller 332 is connected to the backup roller 342. This allows the current IA flowing through the second current route LB and the current IC flowing through the third current route LC to flow through the first current detection unit XA. Thus, the first current detection unit IX may detect the current IA flowing through the second current route LB and the current IC flowing through the third current route LC without using the cleaning current detection unit XD.

Here, if the current IA flowing through the second current route LB and the current IC flowing through the third current route LC flow through the first current detection unit XA at the same time, the first current detection unit XA may not detect respective currents accurately. In order to solve that problem, in the printer 10A of the first modified embodiment, the controller 800A switches the first power supply VA into the off state and switches the second power supply VB into the on state at the time of detection of the current IC flowing through the third current route LC. Thus, the first current detection unit XA may accurately detect the current IC flowing through the third current route LC and may accurately determine the voltage VT3 to be applied to the recovery roller 341 based on the detected current IC. When the determined voltage VT3 is applied to the recovery roller 341 at the time of image formation, the controller 800A may accurately control the current IA flowing through the second current route LB at the time of image formation by subtracting the detected current IC from the current IA detected by the first current detection unit XA at the time of image formation. Further, when the first current detection unit XA detects the current IA flowing through the second current route LB, the controller 800A switches the first power supply VA into the on state and switches the second power supply VB the off state. Thus, the first current detection unit XA may accurately detect the current IA flowing through the second current route LB, and accurately determine the voltage VT2 to be applied to the second transfer roller 650 based on the detected current IA and the humidity detection signal SSA output from the humidity sensor 860.

In the printer 10A of the first modified embodiment, the constant voltage control is executed on the secondary transfer roller 650 at the time of image formation. Here, the width of the sheet W in a left-right direction (Y-axis direction) may be smaller than the width of the secondary transfer roller 650 in the left-right direction. In that case, if constant current control is executed on the secondary transfer roller 650 at the time of image formation, at least one end of the secondary transfer roller 650 in the left-right direction may make contact with the belt 331. This causes current to flow across the secondary transfer roller 650 and the driving roller 332 via the belt 331, deteriorating image quality. In order to that problem, in the printer 10A of the first modified embodiment, the constant voltage control is executed on the secondary transfer roller 650 at the time of image formation. This prevents deterioration in image quality which would be caused by variation in width of the sheet W, unlike the case in which the constant current control is executed.

In the following, constitutive parts or components of a printer 10B according to a second modified embodiment, which are the same as or equivalent to those of the printer 10 of the above embodiment, are designated by the same reference numerals, and any explanation therefor will be omitted as appropriate.

Figure 7A:
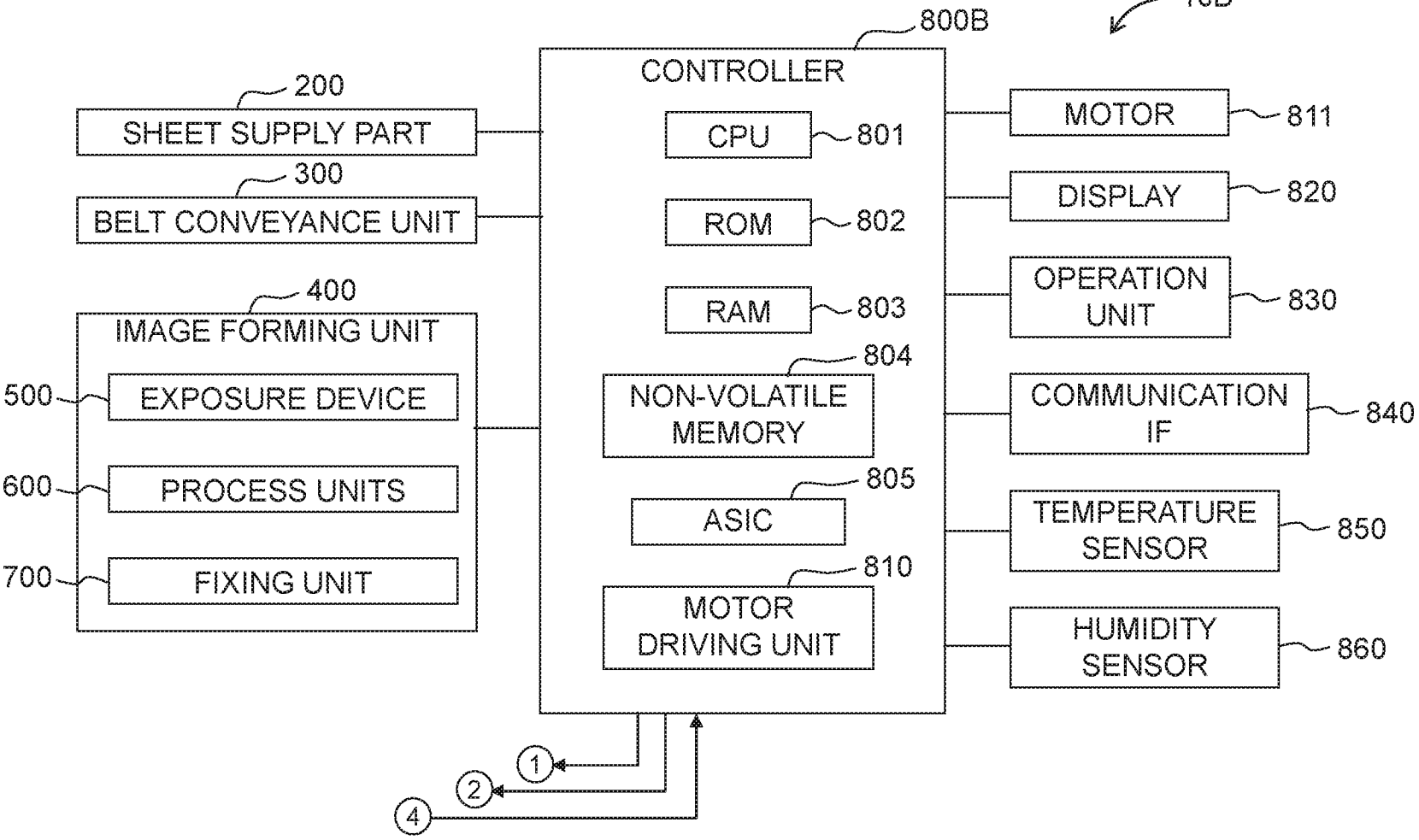
FIGS. 7A and 7B schematically depict an electrical configuration of a printer 10B according to a second modified embodiment.
Figure 7B:
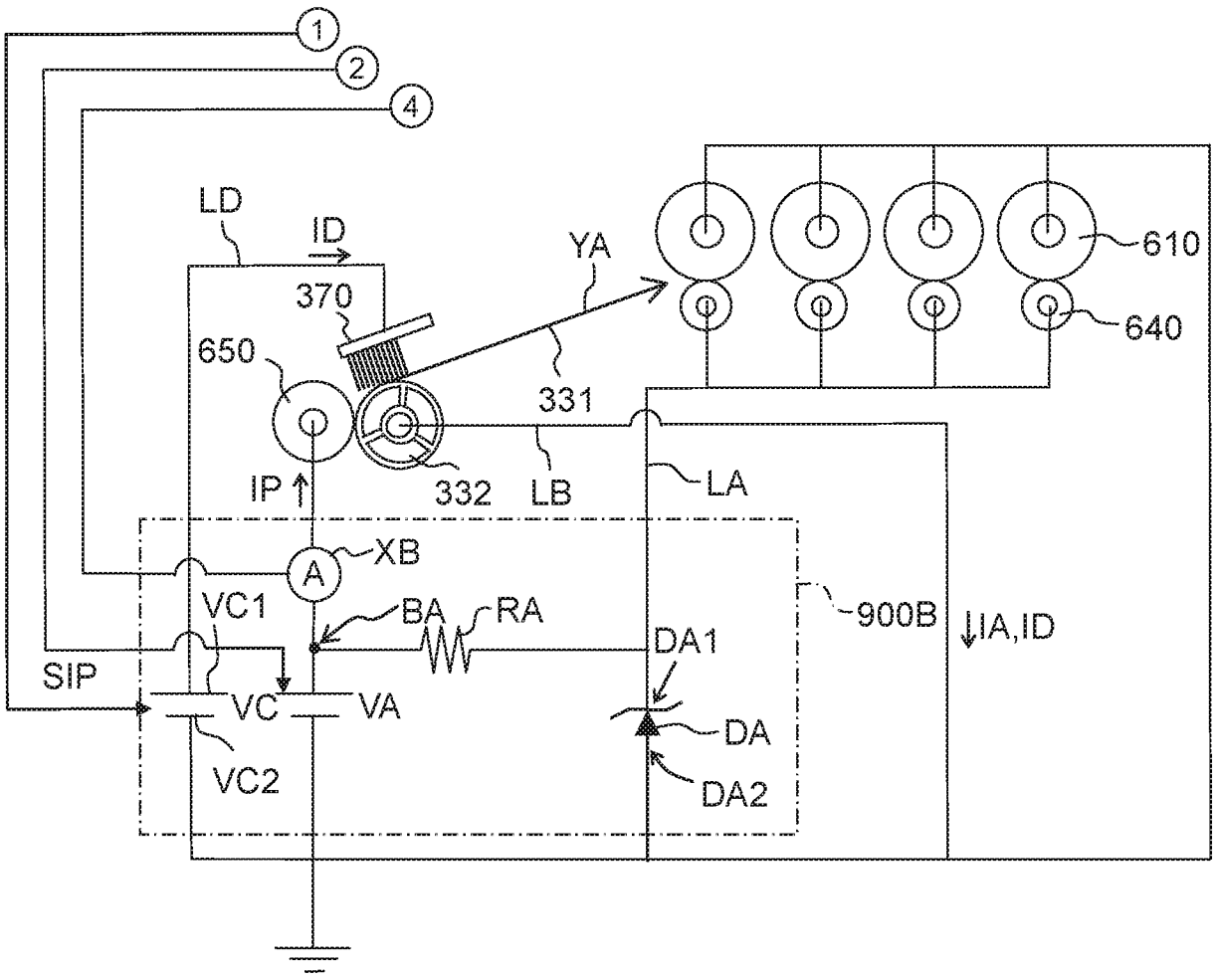

As depicted in FIG. 7, the printer 10B of the second modified embodiment includes a brush 370 in place of the belt cleaning unit 340. The brush 370 is disposed downstream of the secondary transfer roller 650 in the rotation direction YA of the belt 331. The brush 370 is disposed to sandwich the belt 331 between itself and the driving roller 332. The brush 370 is in contact with the outer circumference surface of the belt 331. The brush 370 electrically and mechanically removes toner adhering to the outer circumference surface of the belt 331, when the belt 331 passes a position sandwiched between the brush 370 and the driving roller 332. The brush 370 is an exemplary second contact member.

A power supply substrate 900B does not include the second power supply VB, the first current detection unit XA, and the cleaning current detection unit XD. The power supply substrate 900B, however, includes a third power supply VC and a second current detection unit XB. A positive-electrode terminal VC 1 of the third power source VC is connected to the brush 370. A negative-electrode terminal VC2 of the third power supply VC is connected to the ground. In the power supply substrate 900B connected as described above, a fourth current route LD in which the brush 370 and the driving roller 332 are connected in series in that order is connected to the third power supply VC and to the ground potential. A voltage VT4 is applied to the brush 370. The voltage VT4 to be applied to the brush 370 by the third power supply VC has the same polarity as the voltage VT2 to be applied to the secondary transfer roller 650 by the first power supply VA.

The second current detection unit XB is connected to the first power supply VA and to the secondary transfer roller 650 in the second current route LB. Namely, the second current detection unit XB is connected to the secondary transfer roller 650 and to a branch point BA of the first current route LA and the second current route LB. The second current detection unit XB detects the current IP flowing from the first power supply VA to the secondary transfer roller 650, and outputs a current detection signal SIP depending on the detected current IP.

A controller 800B may detect the current IP based on the current detection signal SIP output from the second current detection unit XB. The controller 800B controls the first power supply VA based on the detected current IP. The controller 800B controls the third power supply VC by using the temperature sensor 850 and the humidity sensor 860. The controller 800B may detect the temperature TA in the casing 100 based on the temperature detection signal STA output from the temperature sensor 850, and may detect the humidity SA in the casing 100 based on the humidity detection signal SSA output from the humidity sensor 860. The controller 800B makes the voltage VP3 to be output from the third power supply VC smaller, as at least one of the detected temperature TA and humidity SA is greater.

In the printer 10B of the second modified embodiment, both of the secondary transfer roller 650 and the brush 370 are arranged to sandwich the belt 331 between themselves and the driving roller 332. This allows the current IA flowing through the second current route LB and the current ID flowing through the fourth current route LD to flow across the driving roller 332 and the ground potential. In that configuration, even when the current flowing across the driving roller 332 and the ground potential is detected, the current IA flowing through the second current route LB may not be detected accurately. In order to solve that problem, in the printer 10B of the second modified embodiment, the second current detection unit XB is connected to the first power supply VA and to the secondary transfer roller 650 in the second current route LB. Thus, the current IP flowing from the first power supply VA to the secondary transfer roller 650 may be detected accurately, making it possible to control the first power supply VA based on the detected current IP.

In the following, constitutive parts or components of a printer 10C according to a third modified embodiment, which are the same as or equivalent to those of the printer 10 of the above embodiment, are designated by the same reference numerals, and any explanation therefor will be omitted as appropriate.

Figure 8A:
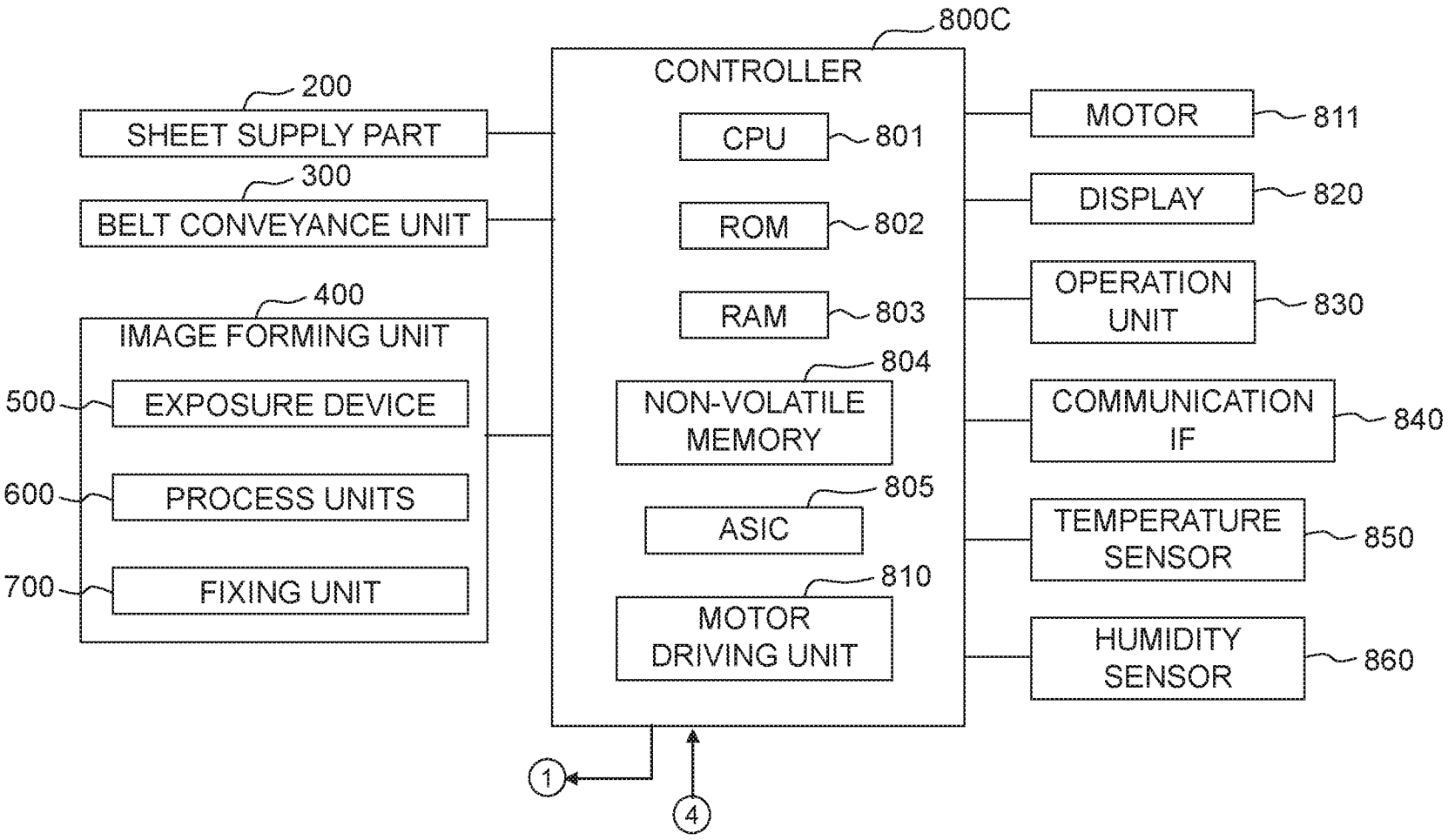
FIGS. 8A and 8B schematically depict an electrical configuration of a printer 10C according to a third modified embodiment.
Figure 8B:
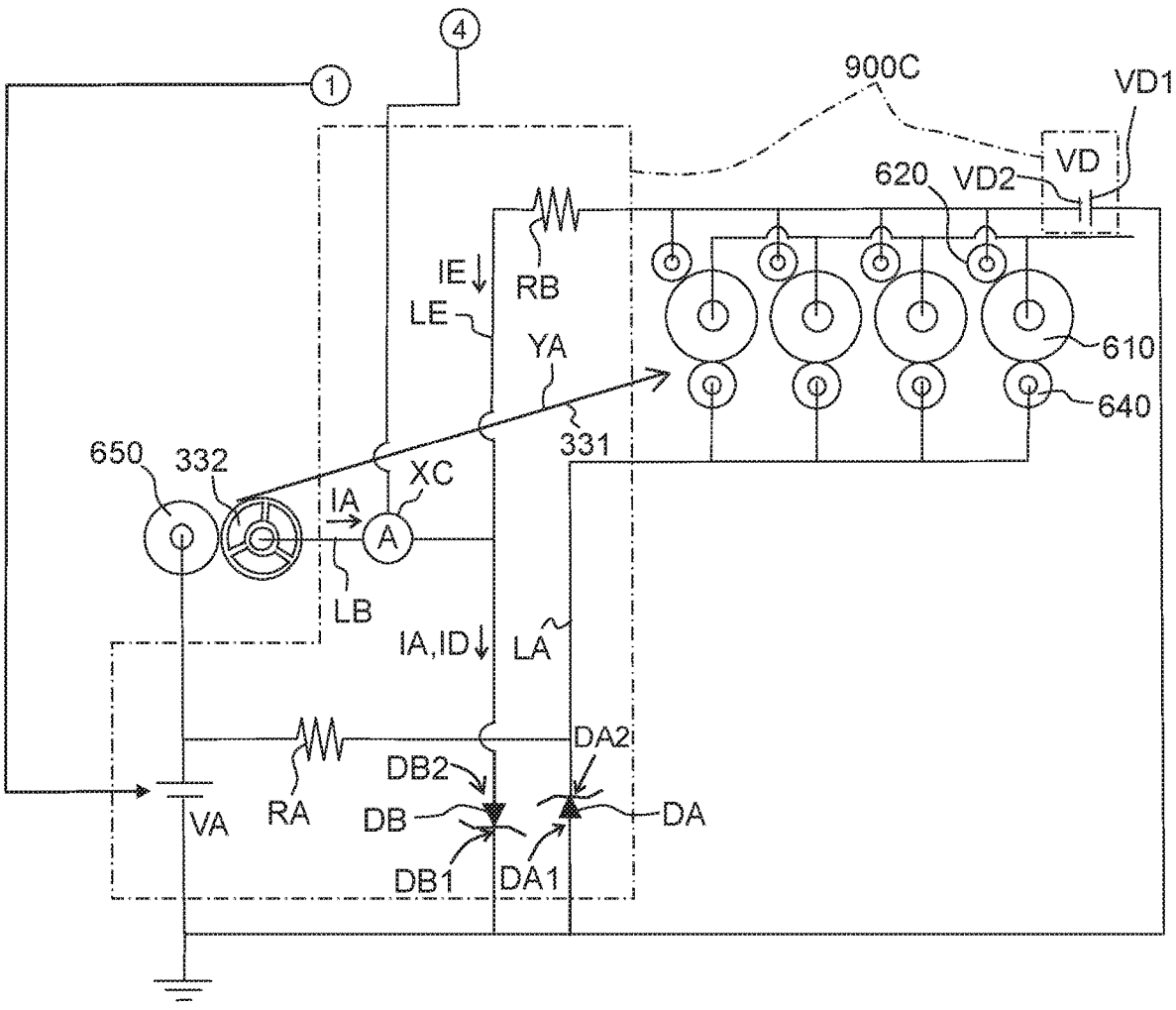
Figure 9:
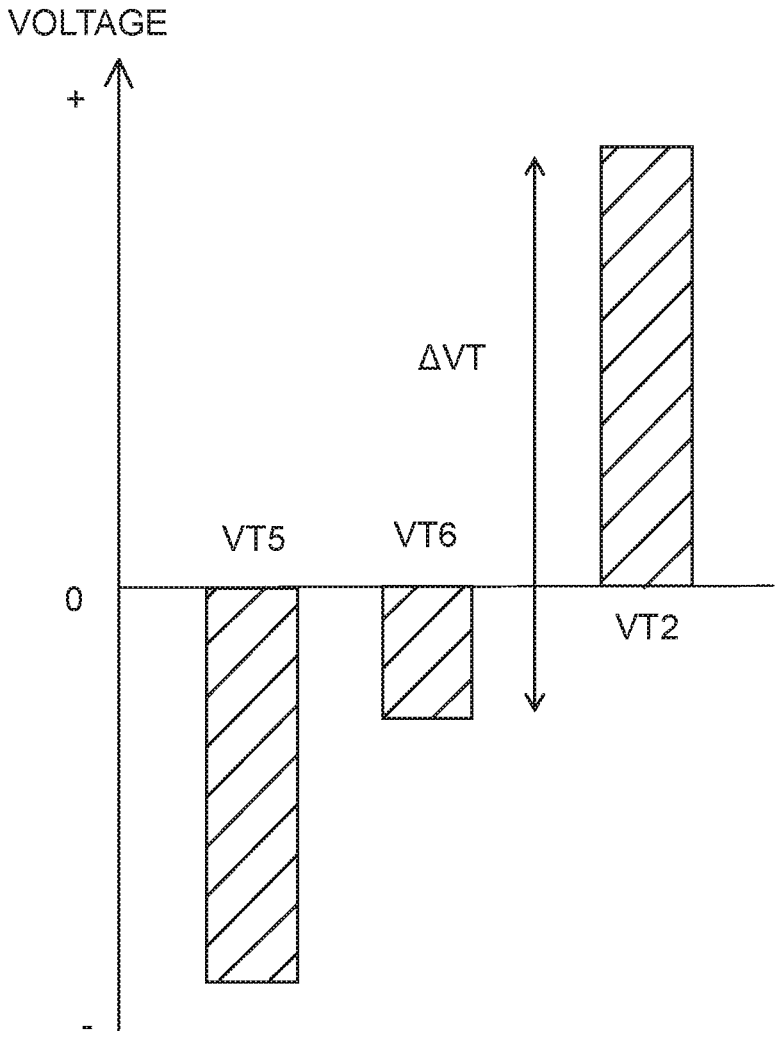
FIG. 9 is a graph indicating relations between a voltage VT5 to be applied to a charging roller 620 and a voltage VT6 to be applied to the driving roller 332 and the voltage VT2 to be applied to the secondary transfer roller 650.

As depicted in FIG. 8, the printer 10C of the third modified embodiment includes no belt cleaning unit 340. A power supply substrate 900C does not include the second power supply VB, the first current detection unit XA, and the cleaning current detection unit XD. The power supply substrate 900C, however, includes a fourth power supply VD, a resistor RB, a constant voltage element DB, and a third current detection unit XC. A positive-electrode terminal VD1 of the fourth power supply VD is connected to the ground. A negative-electrode terminal VD2 of the fourth power supply VD is connected to the charging roller 620. In that configuration, a voltage VT5 is applied to the charging roller 620. The voltage VT5 to be applied to the charging roller 620 by the fourth power supply VD has a reverse polarity to that of the voltage VT2 to be applied to the secondary transfer roller 650 by the first power source VA.

The resistor RB is connected to the charging roller 620 and to the ground potential. The constant voltage element DB is connected to the charging roller 620 and to the ground potential. The resistor RB and the constant voltage element DB are connected in series in that order. The constant voltage element DB is a Zener diode, and a high-voltage terminal DB1 as a cathode is connected to the ground. A low-voltage terminal DB2 as an anode is connected to the resistor RB and to the driving roller 332. The resistor RB is a resistor different from the resistor RA. The resistor RB is an exemplary second resistor, and the constant voltage element DB is an exemplary first constant voltage element.

In the power supply substrate 900C connected as described above, a fifth current route LE in which the charging roller 620, the resistor RB, and the constant voltage element DB are connected in series in that order is connected to the fourth power supply VD and to the ground potential. The driving roller 332 is connected to the resistor RB and to the constant voltage element DB in the fifth current route LE.

The third current detection unit XC is connected to the driving roller 332 and to a part of the fifth current route LE between the resistor RB and the constant voltage element DB. The third current detection unit XC detects the current IA flowing from the second current route LB to the fifth current route LE and outputs the current detection signal SIA depending on the detected current IA. A controller 800C may detect the current IA based on the current detection signal SIA output from the third current detection unit XC. The controller 800C controls the first power supply VA based on the detected current IA.

In the printer 10C of the third modified embodiment, a voltage VT6 having the same polarity as the voltage VT5 to be applied to the charging roller 620 is applied to the driving roller 332. Namely, the voltage VT6 to be applied to the driving roller 332 by the fourth power supply VD has a reverse polarity to that of the voltage VT2 to be applied to the secondary transfer roller 650 by the first power supply VA. Thus, the voltage VT2 to be applied to the secondary transfer roller 650 may be reduced to make a voltage difference ΔVT constant. Accordingly, the voltage VP1 to be output from the first power supply VA may be reduced so that the greatest voltage that may be output from the first power supply VA is made to be small. This in turn reduces power supply cost. Further, since the voltage VT2 to be applied to the secondary transfer roller 650 is reduced, the amount of the leakage current IB may be reduced.

In the printer 10C of the third modified embodiment, the current IA flowing through the second current route LB and a current IE flowing through the fifth current route LE flow across the constant voltage element DB and the ground potential. In that configuration, even when the current flowing across the constant voltage element DB and the ground potential is detected, the current IA flowing through the second current route LB may not be detected accurately. In order to solve that problem, in the printer 10C of the third modified embodiment, the third current detection unit XC is connected to the driving roller 332 and to the part of the fifth current route LE between the resistor RB and the constant voltage element DB. Thus, the current IA flowing through the second current route LB may be detected accurately, making it possible to control the first power supply VA accurately based on the detected current IA.

In the printer 10C of the third modified embodiment, the resistor RB is connected to the charging roller 620 and to the constant voltage element DB. This may prevent variation in a voltage VP4 to be applied to the charging roller 620 which would be otherwise caused by variation in the current IA flowing from the second current route LB to the fifth current route LE.

Technology disclosed in the present specification is not limited to the embodiments and modified embodiments described above, and it may be achieved in various configurations without departing from the gist and scope of the present teaching.

In the above embodiment, the belt cleaning unit 340 is disposed in contact with the part, of the outer circumference of the belt 331, moving from the driving roller 332 to the driven roller 333. The present teaching is not limited to this, and the belt cleaning unit 340 may be disposed, for example, in the vicinity of the driving roller 332. Specifically, the recovery roller 341 is disposed downstream of the secondary transfer roller 650 in the rotation direction YA of the belt 331 to sandwich the belt 331 between itself and the driving roller 332. The recovery roller 341 is in contact with the outer circumference of the belt 331. In that case, the driving roller 332 functions as the backup roller 342. Thus, the belt cleaning unit 340 may eliminate the backup roller 342, making it possible to simplify the configuration of the printer 10.

In the above embodiment, the controller 800 executes the constant voltage control on the secondary transfer roller 650 in the image formation operation. The present teaching, however, is not limited to this. For example, the constant current control may be executed on the secondary transfer roller 650. The constant voltage control executed on the secondary transfer roller 650 at the time of image formation may cause the current IA flowing from the secondary transfer roller 650 to the driving roller 332 via the sheet W to vary, due to, for example, variation in thickness of the sheet W and/or variation in resistance value. This may deteriorate image quality. Compared to the constant voltage control, the constant current control executed on the secondary transfer roller 650 at the time of image formation may reduce the deterioration in image quality which would be otherwise caused by variation in thickness of the sheet W and/or variation in resistance value.

In the above embodiment, the positive-electrode terminal VA1 of the first power supply VA is connected to the primary transfer rollers 640 and to the secondary transfer roller 650, and the negative-electrode terminal VA2 of the first power supply VA is connected to the ground potential. The present teaching, however, is not limited to this. For example, the positive-electrode terminal VA1 of the first power supply VA may be connected to the ground potential, and the negative-electrode terminal VA2 of the first power supply VA may be connected to the primary transfer rollers 640 and to the secondary transfer roller 650. Namely, the polarity of the voltage VT1 to be applied to the primary transfer rollers 640 and the polarity of the voltage VT2 to be applied to the secondary transfer roller 650 may be inverted from those of the above embodiment. In that case, the voltage VT3 to be applied to the recovery roller 341 may be preferably inverted from that of the above embodiment. The same is true on the voltage VT4 to be applied to the brush 370, the voltage VT5 to be applied to the charging roller 620, and the like.

Further, the first power supply VA, the second power supply VB, and the like may be configured such that the polarity of the voltage VT1 to be applied to each primary transfer roller 640, the polarity of the voltage VT2 to be applied to the secondary transfer roller 650, the polarity of the voltage VT3 to be applied to the recovery roller 341, and the like may be invertible. Such a configuration may remove, for example, toner adhering to the outer circumference surface of the recovery roller 341 of the belt cleaning unit 340. Specifically, the first power supply VA causes the polarity of the voltage VT2 to be applied to the secondary transfer roller 650 to be inverted from that at the time of image formation, and the second power supply VB causes the polarity of the voltage VT3 to be applied to the recovery roller 341 to be inverted from that at the time of image formation. This causes the toner adhering to the outer circumference surface of the recovery roller 341 to be transferred to the belt 331. Further, for example, a pair of Zener diodes having low-voltage terminals DA2 connected to each other, the pair of Zener diodes functioning as the constant voltage element DA, is connected to the resistor RA and to the primary transfer rollers 640 in the first current route LA. Thus, the voltage VT1 to be applied to each primary transfer roller 640 has a reverse polarity to that at the time of image formation. This causes the toner transferred to the belt 331 to be transferred to each photosensitive drum 610, and the toner transferred to each photosensitive drum 610 is removed by a cleaning blade (not depicted) provided in each photosensitive drum 610.

In the above embodiment, the cleaning blade may be provided in place of the belt cleaning unit 340. The cleaning blade is disposed downstream of the secondary transfer roller 650 in the rotation direction YA of the belt 331. Further, the cleaning blade is disposed to sandwich the belt 331 between itself and the driving roller 332. The cleaning blade is in contact with the outer circumference surface of the belt 331. The cleaning blade mechanically removes toner adhering to the outer circumference surface of the belt 331 when the belt 331 passes a position sandwiched between the cleaning blade and the driving roller 332. Thus, the power supply substrate 900 may eliminate a power supply that supplies voltage to the cleaning blade. This may downsize the power supply substrate 900, thus consequently downsizing the printer 10.

In the above embodiment, the controller 800 switches the first power supply VA between the on state and the off state when controlling the voltage VT2 to be applied from the first power supply VA to the secondary transfer roller 650. The present teaching, however, is not limited thereto. For example, a switch element may be connected to the controller 800 and to the first power supply VA, and the controller 800 may switch the switch element between a connection state and a disconnection state. In such a case, the controller 800 may control a state in which the voltage VT2 is applied from the first power supply VA to the secondary transfer roller 650 and a state in which the voltage VT2 is not applied from the first power supply VA to the secondary transfer roller 650. The same is true on a case in which the controller 800 controls the voltage VT3 to be applied from the second power supply VB to the recovery roller 341.

In the above embodiment, the constant voltage element DB is the Zener diode. The present teaching, however, is not limited to this. For example, the constant voltage element DB may be a variable resistance. The controller 800 may determine the voltage VT1 to be applied to the primary transfer rollers 640 by controlling the resistance value of the constant voltage element DB.

The constant voltage element DB is not indispensable. The constant voltage element DB may be eliminated, for example, in a configuration in which the resistor RA is a variable resistance and the controller 800 controls the resistance value of the resistor RA to determine the voltage VT1 to be applied to the primary transfer rollers 640.

In the above embodiment, the resistor RA is connected in series to the primary transfer rollers 640. The present teaching, however, is not limited to this. For example, another resistor different from the resistor RA may be connected to the resistor RA and to the primary transfer rollers 640.

The configuration of the printer 10 in the above embodiment is merely an example, and it may be modified in various ways. For example, in the above embodiment, the printer 10 performs printing by using toners of four colors including black, yellow, magenta, and cyan. Toner colors and the number of toners used in printing are not limited to those.

The image forming apparatus is not limited to a single printer, and it may be a copying machine, a facsimile machine, or a multifunction peripheral. The present teaching may be applied to those machines or apparatuses.

What is claimed is:

1. An image forming apparatus, comprising:

a cylindrical intermediate transfer belt;

a photosensitive drum which is in contact with an outer circumference surface of the intermediate transfer belt;

a primary transfer member sandwiching the intermediate transfer belt between the primary transfer member and the photosensitive drum;

a secondary transfer member which is in contact with the outer circumference surface of the intermediate transfer belt;

a first backup member sandwiching the intermediate transfer belt between the first backup member and the secondary transfer member;

a first power supply electrically connected to the primary transfer member and to the secondary transfer member; and a first resistor electrically connected to the first power supply and to the primary transfer member, wherein a first current route, in which the first resistor, the primary transfer member, and the photosensitive drum are connected in series in that order, is connected to the first power supply and to a basis potential, a second current route, in which the secondary transfer member and the first backup member are connected in series, is connected to the first power supply and to the basis potential, and the first current route is connected in parallel to the second current route.

2. The image forming apparatus according to claim 1, further comprising a first current detector electrically connected to the first backup member and to the basis potential.

3. The image forming apparatus according to claim 2, further comprising:

a first contact member disposed downstream of the secondary transfer member and upstream of the photosensitive drum in a rotation direction of the intermediate transfer belt, the first contact member being in contact with the outer circumference surface of the intermediate transfer belt;

a second backup member sandwiching the intermediate transfer belt between the second backup member and the first contact member, the second backup member connected to the first backup member; and a second power supply electrically connected to the first contact member, wherein a third current route, in which the first contact member, the second backup member, and the first current detector are connected in series in that order, is electrically connected to the second power supply and to the basis potential, and a voltage to be applied to the second transfer member by the first power supply has the same polarity as a voltage to be applied to the first contact member by the second power supply.

4. The image forming apparatus according to claim 3, further comprising a controller operatively connected to the first power supply and to the second power supply, the controller being configured to execute:

switching the first power supply between an on state and an off state;

switching the second power supply between an on state and an off state;

determining a first applied voltage to be applied to the secondary transfer member based on a current detected by the first current detector, in a case that the controller switches the first power supply into the on state and switches the second power supply into the off state; and applying a constant voltage to the secondary transfer member by the first power supply in image formation, wherein the constant voltage is equal to the first applied voltage.

5. The image forming apparatus according to claim 3, further comprising a controller operatively connected to the first power supply and to the second power supply, the controller being configured to execute:

switching the first power supply between an on state and an off state;

switching the second power supply between an on state and an off state;

determining a second applied voltage to be applied to the first contact member based on a current detected by the first current detector, in a case that the controller switches the first power supply into the off state and switches the second power supply into the on state;

applying a constant voltage to the first contact member by the second power supply in image formation, wherein the constant voltage is equal to the second applied voltage; and applying a constant current to the secondary transfer member by the first power supply in image formation.

6. The image forming apparatus according to claim 3, further comprising a belt cleaning unit disposed in contact with the outer circumference surface of the intermediate transfer belt, the belt cleaning unit including a recovery roller and a backup roller, wherein the recovery roller is the first contact member and the backup roller is the second backup member.

7. The image forming apparatus according to claim 1, further comprising:

a second contact member disposed downstream of the secondary transfer member in a rotation direction of the intermediate transfer belt, the second contact member being in contact with the outer circumference surface of the intermediate transfer belt, the second contact member sandwiching the intermediate transfer belt between the second contact member and the first backup member;

a third power supply electrically connected to the second contact member; and a second current detector electrically connected to the first power supply and to the secondary transfer member in the second current route, wherein a fourth current route, in which the second contact member and the first backup member are connected in series in that order, is electrically connected to the third power supply and to the basis potential, and a voltage to be applied to the secondary transfer member by the first power supply has the same polarity as a voltage to be applied to the second contact member by the third power supply.

8. The image forming apparatus according to claim 7, further comprising:

at least one of a temperature sensor and a humidity sensor; and a controller operatively connected to the third power supply, the controller being configured to execute outputting a voltage by the third power supply in such a manner that the voltage output by the third power supply decreases, as at least one of temperature detected by the temperature sensor and humidity detected by the humidity sensor increases.

9. The image forming apparatus according to claim 7, wherein the second contact member is a brush.

10. The image forming apparatus according to claim 1, further comprising:

a charger configured to charge the photosensitive drum;

a fourth power supply electrically connected to the charger;

a second resistor different from the first resistor; and a first constant voltage element, wherein a fifth current route, in which the charger, the second resistor, and the first constant voltage element are connected in series in that order, is electrically connected to the fourth power supply and to the basis potential, a voltage to be applied to the secondary transfer member by the first power supply has a polarity different from that of a voltage to be applied to the charger by the fourth power supply, the first backup member is electrically connected to a part of the fifth current route between the second resistor and the first constant voltage element, and the voltage to be applied to the secondary transfer member by the first power supply has a polarity different from that of a voltage to be applied to the first backup member by the fourth power supply.

11. The image forming apparatus according to claim 10, further comprising a third current detector electrically connected to the first backup member and to the part of the fifth current route between the second resistor and the first constant voltage element.

12. The image forming apparatus according to claim 10, wherein the first constant voltage element is a Zener diode.

13. The image forming apparatus according to claim 1, further comprising a second constant voltage element connected to the basis potential and to a part of the first current route between the first resistor and the primary transfer member.

14. The image forming apparatus according to claim 13, wherein the second constant voltage element is a Zener diode.

15. The image forming apparatus according to claim 1, wherein the first backup member is a driving roller; and the intermediate transfer belt is stretched between the driving roller and a driven roller.

16. The image forming apparatus according to claim 1, wherein the basis potential is a ground potential.

17. A method of controlling an image forming apparatus, the image forming apparatus comprising:

a cylindrical intermediate transfer belt;

a photosensitive drum which is in contact with an outer circumference surface of the intermediate transfer belt;

a primary transfer member sandwiching the intermediate transfer belt between the primary transfer member and the photosensitive drum;

a secondary transfer member which is in contact with the outer circumference surface of the intermediate transfer belt;

a backup member sandwiching the intermediate transfer belt between the backup member and the secondary transfer member;

a power supply electrically connected to the secondary transfer member;

a resistor electrically connected to the power supply and to the primary transfer member; and a current detector electrically connected to the backup member and to a basis potential, wherein a first current route, in which the resistor, the primary transfer member, and the photosensitive drum are connected in series in that order, is connected to the power supply and to the basis potential, a second current route, in which the secondary transfer member, the backup member, and the current detector are connected in series in that order, is connected to the power supply and to the basis potential, and the first current route is connected in parallel to the second current route, the method comprising:

detecting a current flowing through the second current route by the current detector; and determining a voltage to be applied to the secondary transfer member based on the current detected by the current detector.

18. A non-transitory computer readable medium storing a computer program which is to be executed on an image forming apparatus to control the image forming apparatus, the image forming apparatus comprising:

a cylindrical intermediate transfer belt;

a photosensitive drum which is in contact with an outer circumference surface of the intermediate transfer belt;

a primary transfer member sandwiching the intermediate transfer belt between the primary transfer member and the photosensitive drum;

a secondary transfer member which is in contact with the outer circumference surface of the intermediate transfer belt;

a backup member sandwiching the intermediate transfer belt between the backup member and the secondary transfer member;

a power supply electrically connected to the secondary transfer member;

a resistor electrically connected to the power supply and to the primary transfer member; and a current detector electrically connected to the backup member and to a basis potential, wherein a first current route, in which the resistor, the primary transfer member, and the photosensitive drum are connected in series in that order, is connected to the power supply and to the basis potential, a second current route, in which the secondary transfer member, the backup member, and the current detector are connected in series in that order, is connected to the power supply and to the basis potential, and the first current route is connected in parallel to the second current route, wherein the program causes the image forming apparatus to execute:

detecting a current flowing through the second current route by the current detector; and determining a voltage to be applied to the secondary transfer member based on the current detected by the current detector.

19. The image forming apparatus according to claim 13, further comprising a power supply substrate on which the first power supply, the first resistor and the second constant voltage element are mounted.

20. The image forming apparatus according to claim 2, further comprising:

a first contact member disposed downstream of the secondary transfer member and upstream of the photosensitive drum in a rotation direction of the intermediate transfer belt, the first contact member being in contact with the outer circumference surface of the intermediate transfer belt;

a second backup member sandwiching the intermediate transfer belt between the second backup member and the first contact member, the second backup member connected to the first backup member; and a second power supply electrically connected to the first contact member, wherein a third current route, in which the first contact member, the second backup member, and the first current detector are connected in series in that order, is electrically connected to the second power supply and to the basis potential.

21. The image forming apparatus according to claim 2, further comprising a controller operatively connected to the first power supply, the controller being configured to determine a voltage to be applied to the secondary transfer member based on a detection result of the first current detector.

22. The image forming apparatus according to claim 2, wherein the first current detector is electrically connected between the first backup member and the basis potential, and, wherein the first current detector detects a current and outputs a current detection signal based on the detected current.

* * * * *